US006701725B2

(12) United States Patent
Rossi et al.

(10) Patent No.: US 6,701,725 B2
(45) Date of Patent: Mar. 9, 2004

(54) ESTIMATING OPERATING PARAMETERS OF VAPOR COMPRESSION CYCLE EQUIPMENT

(75) Inventors: Todd M. Rossi, Princeton, NJ (US); Jonathan D. Douglas, Lawrenceville, NJ (US); Marcus V. A. Bianchi, Newtown, PA (US)

(73) Assignee: Field Diagnostic Services, Inc., Langhorne, PA (US)

( * ) Notice: Subject to any disclaimer, the term of this patent is extended or adjusted under 35 U.S.C. 154(b) by 32 days.

(21) Appl. No.: 10/143,464

(22) Filed: May 10, 2002

(65) Prior Publication Data

US 2003/0019221 A1 Jan. 30, 2003

Related U.S. Application Data

(60) Provisional application No. 60/290,433, filed on May 11, 2001.

(51) Int. Cl.[7] ..... F25B 49/02

(52) U.S. Cl. ..... 62/125; 62/129; 62/230; 702/182

(58) Field of Search ..... 62/125, 126, 127, 62/129, 130, 203, 204, 208, 209, 210, 228.1, 228.3, 228.4, 228.5, 230, 229; 702/182, 183

(56) References Cited

U.S. PATENT DOCUMENTS

| | | | | |
|---|---|---|---|---|
| 3,082,951 A | | 3/1963 | Kayan | |
| 3,707,851 A | | 1/1973 | McAshan, Jr. | |
| 3,736,765 A | | 6/1973 | O'Dell | |
| 4,114,448 A | | 9/1978 | Merritt | |
| 4,161,106 A | | 7/1979 | Savage et al. | |
| 4,186,563 A | | 2/1980 | Schulze, Sr. | |
| 4,217,761 A | | 8/1980 | Cornaire et al. | |
| 4,325,223 A | | 4/1982 | Cantley | |
| 4,432,232 A | | 2/1984 | Brantley et al. | |
| 4,510,576 A | | 4/1985 | MacArthur et al. | |
| 4,611,470 A | | 9/1986 | Enström | |
| 4,768,346 A | | 9/1988 | Mathur | |
| 4,885,914 A | | 12/1989 | Pearman | |
| 5,083,438 A | | 1/1992 | McMullin | |
| 6,128,910 A | * | 10/2000 | Faircloth | 62/129 |
| 6,272,868 B1 | | 8/2001 | Grabon et al. | |
| 6,438,981 B1 | * | 8/2002 | Whiteside | 62/228.1 |
| 6,532,754 B2 | * | 3/2003 | Haley et al. | 62/129 |

OTHER PUBLICATIONS

A. E. Dabiri and C. K. Ric, 1981. "A Compressor Simulation Model with Corrections for the Level of Suction Gas Superheat," ASHRAE Transactions, Vol, 87, Part 2, pp. 771–782.

1999 Standard for Positive Displacement Refrigerant Compressors and Compressor Units; by ARI; Arlington, VA © 1999.

* cited by examiner

*Primary Examiner*—Harry B. Tanner
(74) *Attorney, Agent, or Firm*—Mark A. Garzia, P.C.; Mark A. Garzia, Esq.

(57) ABSTRACT

A process for estimating the capacity and the coefficient of performance by taking common measurements and using compressor manufacturer's performance data is presented. A process for determining a capacity index and an efficiency index for a vapor compression cycle relative to desired operating conditions.

21 Claims, 3 Drawing Sheets

ESTIMATING OPERATING PARAMETERS OF VAPOR COMPRESSION CYCLE EQUIPMENT

CROSS REFERENCE TO RELATED APPLICATIONS

The present application claims the benefit under any relevant U.S. statute to U.S. Provisional Application No. 60/290,433 filed May 11, 2001, titled ESTIMATING THE EFFICIENCY OF A VAPOR COMPRESSION CYCLE in the name of Todd Rossi and Jon Douglas.

FIELD OF THE INVENTION

The present invention relates generally to heating/ventilation/air conditioning/and refrigeration (HVAC&R) systems; it specifically addresses estimating the capacity and the coefficient of performance as well as defining and estimating an efficiency index and capacity index of a vapor compression cycle under actual operating conditions.

BACKGROUND OF THE INVENTION

Air conditioners, refrigerators and heat pumps are all classified as HVAC&R systems. The most common technology used in all these systems is the vapor compression cycle (often referred to as the refrigeration cycle). Four major components (compressor, condenser, expansion device, and evaporator) connected together via a conduit (preferably copper tubing) to form a closed loop system perform the primary functions which form the vapor compression cycle.

The efficiency of vapor compression cycles is traditionally described by a coefficient of performance (COP) or an energy efficiency ratio (EER). The COP is defined as the ratio of the heat absorption rate from the evaporator over the input power provided to the cycle, or conversely for heat pumps, the rate of heat rejection by the condenser over the input power provided to the cycle.

Knowing a vapor compression cycle's COP is crucial to determine the electrical costs of operating the HVAC system over time. Faults, such as improper refrigerant level and dirty heat exchanger coils, may lower the efficiency of the HVAC system by lowering the capacity of the HVAC system or increasing the power consumption, or both. Thus, even if the instantaneous power consumption of the HVAC system does not vary, a lower capacity will demand longer run time from the system to remove the same amount of heat (in an AC or refrigeration system) from the conditioned space, thereby increasing the energy consumption over a period of time. Both effects of lowering capacity or increasing power translate into lower COP. Proper service of vapor compression cycle equipment is fundamental to keep the COP near the optimum values they had when they were manufactured.

The condenser and evaporator of vapor compression cycle equipment are heat exchangers. Capacity measurements of an HVAC system can be relatively complex; they require the knowledge of the mass flow rate and enthalpies in either side of the heat exchanger's streams (refrigerant or secondary fluid—air or brine—side). To date, mass flow rate measurements in either side are either expensive or inaccurate. Moreover, capacity measurements and calculations are usually beyond the ability of a typical HVACR service technician.

Assessing the COP of vapor compression cycles is also challenging. The electrical power input and the unit capacity need to be simultaneously measured. Power measurements involve equipment that is expensive.

For air-cooled HVAC systems, the coefficient of performance depends strongly on the load under which the cycle is running. (In this description, "air-cooled" means that the condenser and evaporator are exposed to the atmosphere and all heat exchange takes place between the heat exchanger and air.) Thus, the COP of equipment running under different loads can not be directly compared. For that reason, an efficiency index (EI) and a capacity index (CI) are defined in the present invention to allow for comparisons between cycle performance in varying conditions.

SUMMARY OF THE INVENTION

The present invention includes a method for estimating the efficiency and the capacity of a refrigeration, air conditioning or heat pump system operating under field conditions by measuring four system parameters and calculating these performance parameters based on the measurements. In addition to the four measurements, the outdoor ambient temperature is used to calculate an efficiency index (EI), which is related to the COP, and a capacity index (CI). Power or mass flow rate measurements are not required in a primary embodiment of the present invention.

Once the EI and the CI of the system are determined, the principles and methods of the present invention can assist a service technician in locating specific problems. They can also be used to verify the effectiveness of any procedure performed by the service technician, which ultimately may lead to a more effective repair that increases the efficiency of the system. A procedure to estimate the operating costs of running the equipment, as detailed in the present invention, uses the values of EI and CI.

The present invention is intended for use with any manufacturer's HVAC&R equipment. The present invention, when implemented in hardware/firmware, is relatively inexpensive and does not strongly depend on the skill or abilities of a particular service technician. Therefore, uniformity of service can be achieved by utilizing the present invention, but more importantly the quality of the service received by the HVAC system is improved.

The present process includes the step of measuring liquid line pressure, suction line pressure, suction line temperature, and liquid line temperature. After these four measurements are taken, the suction dew point and discharge dew point temperatures from the suction line and liquid line pressures must be obtained. Next, the suction line superheat, the mass flow rate that corresponds to the compressor in the vapor compression cycle for the dew point temperatures and suction line superheat must be obtained, and the enthalpies at the suction line and at the inlet of the evaporator must be obtained. The capacity of the vapor compression cycle from the mass flow rate and the enthalpies across the evaporator can now be calculated.

BRIEF DESCRIPTION OF THE DRAWINGS

The accompanying drawings, which is incorporated in, and form a part of the specification, illustrates the embodiments of the present invention and, together with the description, serve to explain the principles of the invention. For the purpose of illustrating the present invention, the drawings show embodiments that are presently preferred; however, the present invention is not limited to the precise arrangements and instrumentalities shown in the document.

In the drawings.

DETAILED DESCRIPTION OF PREFERRED EMBODIMENTS

In describing preferred embodiments of the invention, specific terminology has been selected for clarity. However, the invention is not intended to be limited to the specific terms so selected, and it is to be understood that each specific term includes all technical equivalents that operate in a similar manner to accomplish a similar purpose.

The vapor compression cycle is the principle upon which conventional air conditioning systems, heat pumps, and refrigeration systems are able to cool (or heat, for heat pumps) and dehumidify air in a defined volume (e.g., a living space, an interior of a vehicle, a freezer, etc.). The vapor-compression cycle is made possible because the refrigerant is a fluid that exhibits specific properties when it is placed under varying pressures and temperatures.

Figure 1:
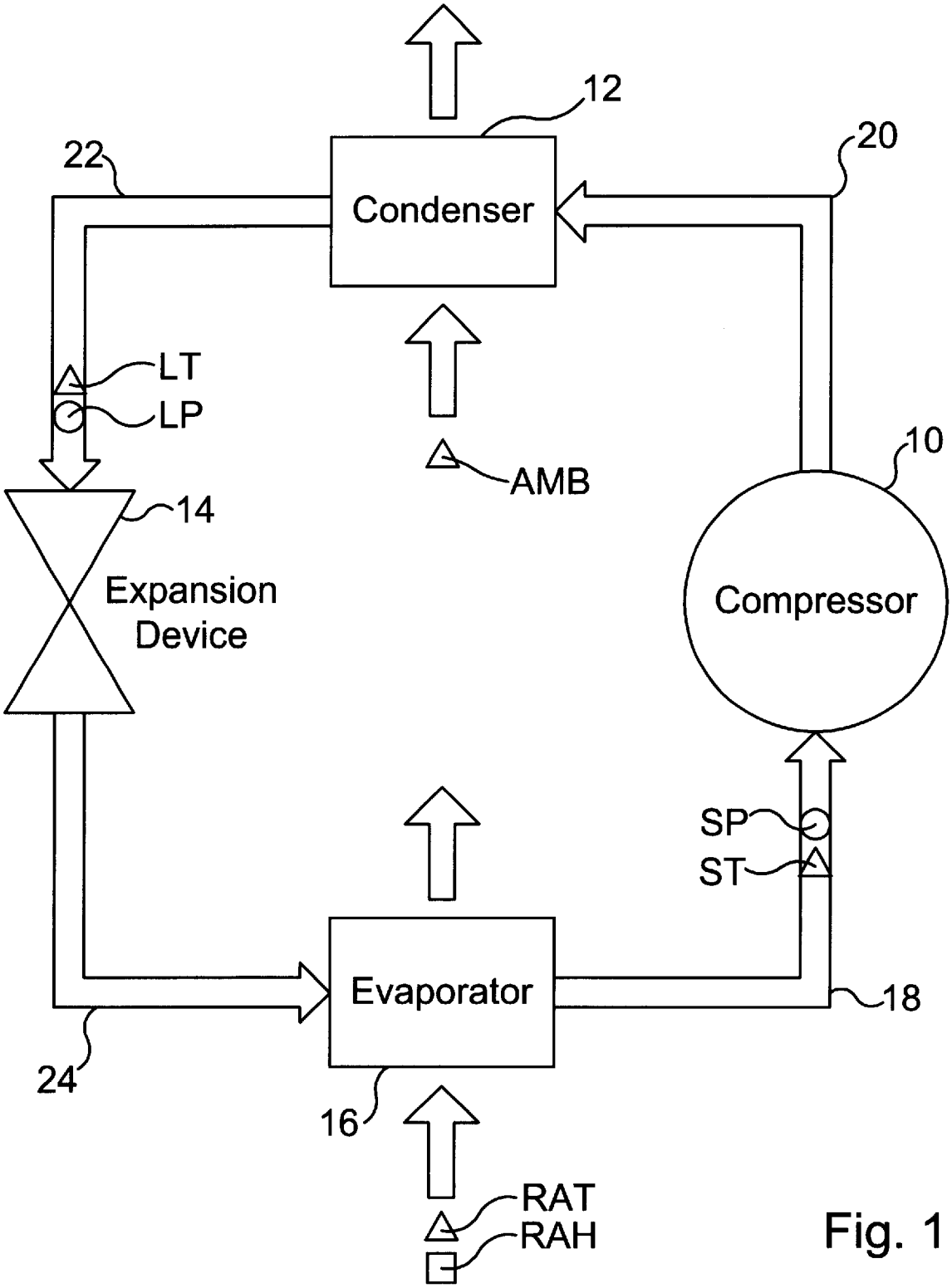
FIG. 1 is a block diagram of a conventional vapor compression cycle.

A typical vapor compression cycle system is illustrated in FIG. 1. The system is a closed loop system and includes a compressor 10, a condenser 12, an expansion device 14 and an evaporator 16. The various components are connected via a conduit (usually copper tubing). The refrigerant continuously circulates through the four components via the conduit and will change state, as defined by its properties such as temperature and pressure, while flowing through each of the four components.

Refrigerant in the majority of heat exchangers is a two-phase vapor-liquid mixture at the required condensing and evaporating temperatures and pressures. Some common types of refrigerant include R-22, R-134A, and R-410A. The main operations of a vapor compression cycle are compression of the refrigerant by the compressor 10, heat rejection by the refrigerant in the condenser 12, throttling of the refrigerant in the expansion device 14, and heat absorption by the refrigerant in the evaporator 16.

In the vapor compression cycle, the refrigerant nominally enters the compressor 10 as a slightly superheated vapor (its temperature is greater than the saturated temperature at the local pressure) and is compressed to a higher pressure. The compressor 10 includes a motor (usually an electric motor) and provides the energy to create a pressure difference between the suction line and the discharge line and to force the refrigerant to flow from the lower to the higher pressure. The pressure and temperature of the refrigerant increases during the compression step. The pressure of the refrigerant as it enters the compressor is referred to as the suction pressure and the pressure of the refrigerant as it leaves the compressor is referred to as the head or discharge pressure. The refrigerant leaves the compressor as highly superheated vapor and enters the condenser 12.

Continuing to refer to FIG. 1, a "typical" air-cooled condenser 12 comprises single or parallel conduits formed into a serpentine-like shape so that a plurality of rows of conduit is formed parallel to each other. Although the present document makes reference to air-cooled condensers, the invention also applies to other types of condensers. Metal fins or other aids are usually attached to the outer surface of the serpentine-shaped conduit in order to increase the transfer of heat between the refrigerant passing through the condenser and the ambient air.

As refrigerant enters a "typical" condenser, the superheated vapor first becomes saturated vapor in the approximately first quarter section of the condenser, and the saturated vapor undergoes a phase change in the remainder of the condenser at approximately constant pressure. Heat is rejected from the refrigerant as it passes through the condenser and the refrigerant nominally exits the condenser as slightly subcooled liquid (its temperature is lower than the saturated temperature at the local pressure).

The expansion (or metering) device 14 reduces the pressure of the liquid refrigerant thereby turning it into a saturated liquid-vapor mixture at a lower temperature, before the refrigerant enters the evaporator 16. This expansion is also referred as the throttling process. The expansion device is typically a capillary tube or fixed orifice in small capacity or low-cost air conditioning systems, and a thermal expansion valve (TXV or TEV) or electronic expansion valve (EXV) in larger units. The TXV has a temperature-sensing bulb on the suction line. It uses that temperature information along with the pressure of the refrigerant in the evaporator to modulate (open and close) the valve to try to maintain proper compressor inlet conditions. The temperature of the refrigerant drops below the temperature of the indoor ambient air as the refrigerant passes through the expansion device. The refrigerant enters the evaporator 16 as a low quality saturated mixture. ("Quality" is defined as the mass fraction of vapor in the liquid-vapor mixture.)

A direct expansion evaporator 16 physically resembles the serpentine-shaped conduit of the condenser 12. Ideally, the refrigerant completely boils by absorbing energy from the defined volume to be cooled (e.g., the interior of a refrigerator). In order to absorb heat from this ambient volume, the temperature of the refrigerant must be lower than that of the volume to be cooled. Nominally, the refrigerant leaves the evaporator as slightly superheated gas at the suction pressure of the compressor and reenters the compressor thereby completing the vapor compression cycle. (It should be noted that the condenser 12 and the evaporator 16 are types of heat exchangers and are sometimes referred to as such in the text.)

Although not shown in FIG. 1, a fan driven by an electric motor is usually positioned next to the evaporator 16; a separate fan/motor combination is also usually positioned next to the condenser 12. The fan/motor combinations increase the airflow over their respective evaporator or condenser coils, thereby enhancing the heat transfer. For the evaporator in cooling mode, the heat transfer is from the indoor ambient volume to the refrigerant flowing through the evaporator; for the condenser in cooling mode, the heat transfer is from the refrigerant flowing through the condenser to the outside air. A reversing valve is used in heat pumps to properly reverse the flow of refrigerant, such that the outside heat exchanger (the condenser in cooling mode) becomes an evaporator and the indoor heat exchanger (the evaporator in cooling mode) becomes a condenser in heating mode.

Finally, although not shown in FIG. 1, there is a control system that allows users to operate and adjust the desired temperature within the ambient volume. The most basic control system for an air conditioning system comprises a low voltage thermostat that is mounted on a wall inside the ambient volume, and contacts that control the electric current delivered to the compressor and fan motors. When the temperature in the ambient volume rises above a predetermined value on the thermostat, a switch closes in the thermostat, forcing the relays to close, thereby making contact, and allowing current to flow through the compressor and the motors of the fan/motors combinations. When the vapor compression cycle has cooled the air in the ambient volume below the predetermined value set on the thermostat, the switch opens thereby causing the relays to open and turning off the current through the compressor and the motors of the fan/motor combination.

There are common degradation faults in systems that utilize a vapor compression cycle. For example, heat exchanger fouling and improper refrigerant charge both result in a lower efficiency and a reduction in capacity. Degradation faults naturally build up slowly over time and repairing them is often a balance between the cost of servicing the equipment (e.g., cleaning heat exchangers) and the benefits derived from returning the system to optimum (or at least an increase in) efficiency.

The present invention is an effective process for using data provided by compressor manufacturers along with measurements easily and commonly made in the field to:

1. Estimate the efficiency degradation of a unit operating in the field;
2. Estimate the improvement in efficiency after servicing the unit; and
3. Determine whether a compressor is performing within its manufacturer's specification.

The present invention is useful for (respectively):

A. Balancing the costs of service and energy, thereby permitting the owner/operator to make more informed decisions about when the degradation faults significantly impact operating costs such that they require attention or servicing.

B. Verify the effectiveness of the service carried out by service field technicians to ensure that all services were performed properly.

C. Help determine if the compressor is operating as designed, or if its performance is part of the problem.

The present invention is a method and process that makes practical capacity and efficiency estimates of vapor compression cycles operating in the field. The present invention is preferably implemented by a microprocessor-based system; however, different devices, hardware and/or software embodiments may be utilized to carry out the disclosed process. After a reading of the present disclosure of the method and process, one skilled in the art will be able to develop specific devices that can perform the subject invention.

Referring again to FIG. 1, the important states of a vapor compression cycle may be described as follows:

State 1: Refrigerant leaving the evaporator and entering the compressor. (The tubing connecting the evaporator to the compressor is called the suction line 18.)

State 2: Refrigerant leaving the compressor and entering the condenser (The tubing connecting the compressor to the condenser is called the discharge or hot gas line 20).

State 3: Refrigerant leaving the condenser and entering the expansion device. (The tubing connecting the condenser and the expansion device is called the liquid line 22).

State 4: Refrigerant leaving the expansion device and entering the evaporator (connected by tubing 24).

The numbers (1 through 4) are used as subscripts in this document to indicate that a property is evaluated at one of the states above.

In the present invention, only four measurements are necessary to estimate the capacity and the COP of the vapor compression cycle equipment:

ST—refrigerant temperature at the suction line or suction temperature (state 1), SP—refrigerant pressure at the suction line or suction pressure (state 1), LT—refrigerant temperature at the liquid line or liquid temperature (state 3), LP—refrigerant pressure at the liquid line or liquid pressure (state 3).

The calculation of CI and EI additionally requires

AMB—temperature of the secondary fluid (e.g. air) entering condenser. The locations of the sensors are shown in the schematic diagram of FIG. 1.

Although a primary embodiment only requires the aforementioned five measurements, a more refined estimate may be achieved if the return air temperature (RAT) and the return air humidity (RAH) taken at the evaporator are also measured. Also, some manufacturer's charging charts require the indoor driving conditions to determine the superheat expectation. Accordingly, this disclosure teaches how to estimate the required operating parameters with either five or seven measurements.

Various gauges and sensors are known in the art that are capable of making the measurements. HVACR service technicians almost universally carry such gauges and sensors with them when servicing a system. Also, those in the art will understand that some of the measurements can be substituted in order to determine the efficiency. For example, the saturation temperature in the evaporator and the saturation temperature in the condenser can be used to replace the suction pressure and liquid pressure measurements, respectively. In a preferred embodiment, the above-mentioned measurements are taken.

Figure 2:
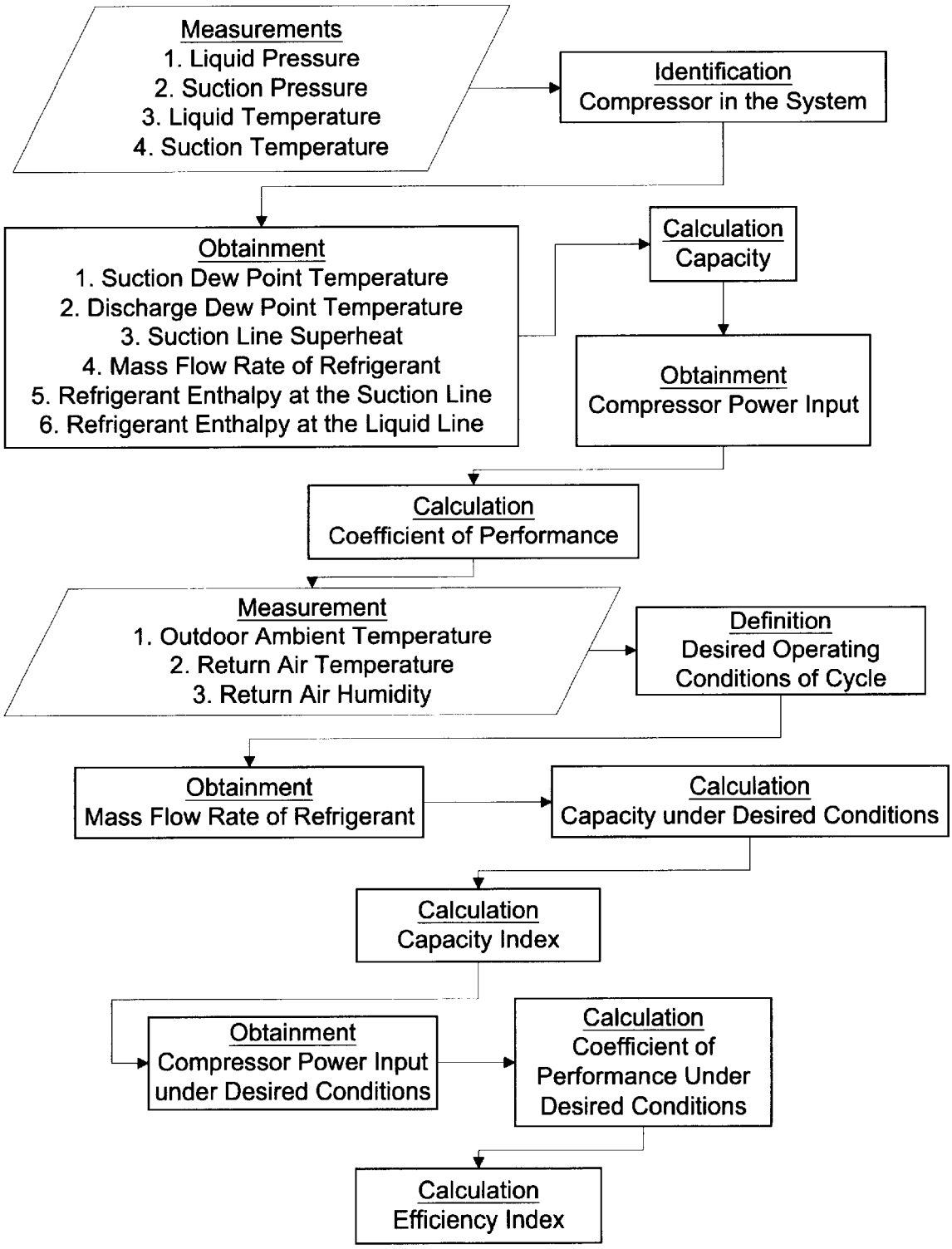
FIG. 2 is a block diagram outlining the major steps of a process for obtaining operating parameters of a HVAC system in accordance with the present invention.

Referring now to FIG. 2, the method consists of the following steps:

A. Measure the liquid and suction pressures (LP and SP, respectively); measure the liquid and suction line temperatures (LT and ST, respectively). These four measurements are sufficient to determine the COP of the equipment. Also determine the load by measuring the outdoor atmospheric temperature (AMB) (if a water-cooled condenser is employed, AMB refers to the water temperature entering the condenser), the return air temperature (RAT) and return air humidity (RAH) (if the return air measurements are not available, assumptions about the evaporator are made). These measurements are all common field measurements that any HVACR technician makes using currently available equipment (e.g., gauges, transducers, thermistors, thermometers, etc.). Use the discharge line access port to measure the discharge pressure DP when the liquid line access port is not available. Even though the pressure drop across the condenser results in an overestimate of subcooling, assume LP is equal to DP or use data provided by the manufacturer to estimate the pressure drop and determine the actual value of LP.

B. Compressor manufacturers make available compressor performance data (compressor maps) in a polynomial format based on Standard 540-1999 created by the Air-Conditioning and Refrigeration Institute (ARI) for each compressor they manufacture. ARI develops and publishes technical standards for industry products, including compressors. The data provided by the standard includes power consumption, mass flow rate, current draw, and compressor efficiency.

Use the standard ARI equation to obtain the compressor's design mass flow rate ($\dot{m}_{map}$), power consumption ($\dot{W}_{map}$), and current draw (I) as a function of its suction dew point temperature (SDT) and discharge dew point temperature (DDT). The dew point temperature is determined directly from the suction refrigerant pressure (SP) and the liquid pressure (LP), from the saturation pressure-temperature relationship. Assume that the pressure drop in the liquid line and condenser is small such that LP is practically the compressor discharge pressure.

It will be clear to those skilled in the art, after reading this disclosure, that other equation forms or a look up table of the compressor performance data may be used instead of the ARI form.

Identify the compressor used in the equipment under analysis to determine the set of coefficients to be used. When the coefficients are not available for the specific compressor used, it is acceptable to select a set of coefficients for a similar compressor.

ARI equations are available for different compressors, both from ARI and from the compressor manufacturers. The equations are polynomials of the following form $$\dot{m}_{map} = a_0 + \sum_{i=1}^{3} a_i SDT^i + \sum_{i=4}^{6} a_i DDT^{i-3} + a_7 SDT\ DDT + a_8 SDT\ DDT^2 + a_9 SDT^2 DDT \tag{1}$$

$$\dot{W}_{map} = b_o + \sum_{i=1}^{3} b_i SDT^i + \sum_{i=4}^{6} b_i DDT^{i-3} + b_7 SDT\ DDT + b_8 SDPT\ DDT^2 + b_9 SDT^2 DDT \tag{2}$$

$$I = c_o + \sum_{i=1}^{3} c_i SDT^i + \sum_{i=4}^{6} c_i DDT^{i-3} + c_7 SDT\ DDT + c_8 SDT\ DDT^2 + c_9 SDT^2 DDT \tag{3}$$

where the coefficients $a_i$, $b_i$, and $c_i$ (i=0 to 9, 30 values) are provided for the compressor and are provided by the manufacturer according to ARI Standard 540-1999. The suction dew point and discharge dew point temperatures in equations (1–3) can be in either ° F. or ° C., using the corresponding set of coefficients.

If the compressor performance data is not available for the compressor installed in the unit, the data for a similar compressor can be used to approximate the parameters. It is suggested that the compressor data of the similar compressor be of the same technology as the compressor in the HVAC system being tested and of similar capacity.

For refrigerants that do not present a glide, the suction dew point and the suction bubble point temperatures are exactly the same. In the present document it will be called evaporating temperature (ET). The same is true for the discharge dew point and the discharge bubble point temperatures, in which case it will be called condensing temperature (CT).

Compressor performance equations, such as equations 1–3, are usually defined for a specific suction line superheat ($SH_{map}$), typically 20° F. ARI Standard 540-1999 tabulates the suction line superheat and it is equal to 20° F. (for air-conditioning applications). Under actual operating conditions, however, the suction line superheat may be different than the specified value, depending on the working conditions of the cycle. ARI Standard 540-1999 requires that superheat correction values be available when the superheat is other than that specified.

If the ARI standard superheat corrections are not available, the mass flow rate and the power are corrected using the actual suction line temperature (ST). First, evaluate the suction line design temperature, $ST_{map}$ as $$ST_{map}=ET+SH_{map} \tag{4}$$

Assuming that the compressibility of the gas remains constant, the refrigerant density is inversely proportional to the temperature at the suction pressure. Assume also that the correction that applies to the mass flow rate also applies to the input power. Thus, one may write $$\dot{m} = \frac{ST_{map}}{ST}\dot{m}_{map}, \tag{5}$$

$$\dot{W} = \frac{ST_{map}}{ST}\dot{W}_{map}, \tag{6}$$

where the temperatures must be in an absolute scale (either Kelvin or Rankine).

The power calculated in equation (6) only accounts for the compressor power.

C. This step is optional. Use an industry standard amp meter to measure the actual current in all legs leading to the compressor. Alternatively or perhaps in addition to, use an industry standard power meter to measure the power input to the compressor. This technique can be used in single or three phase compressors. Compare the measured current and/or the measured power input to those predicted in step B. If one or more of the current and/or power input measurements deviate significantly (e.g. 10%), then a problem with the compressor 10 is flagged. Measuring close to predicted current draw and power input indicates that the compressor is operating near expected performance and builds confidence in the accurate use of the mass flow rate ($\dot{m}$) and power ($\dot{W}$) estimates in the subsequent steps.

D. Use the liquid line temperature (LT) and high side pressure (LP) to determine the liquid line subcooling (SC) as $$SC=CT-LT \tag{7}$$

If SC is greater than 0° F., then estimate the liquid line refrigerant specific enthalpy ($h_3$) using the well-known properties of single-phase subcooled refrigerant $$h_3=h(LT, LP). \tag{8}$$

If the refrigerant leaves the condenser as a two-phase mixture, there is no liquid line subcooling, and pressure and temperature are not independent properties, so they can not define the enthalpy. Some other property must be known, such as the quality, $x_3$, to determine the enthalpy at state 3. Since this is difficult, a method for estimating $h_3$ that is easy to evaluate is derived. An energy balance over the area of the condenser coil where a two-phase flow exists leads to $$\dot{m}(h_g-h_3)=\bar{U}A\ CTOA, \tag{9}$$

where $h_g$ is the saturated vapor enthalpy at the liquid pressure, $\bar{U}$ is the average (over the length) overall heat transfer coefficient, and A is the heat exchanger area where two-phase flow exists. Equation (9) applies when $h_f<h_3<h_g$ (i.e. when a mixture exits the condenser), which may happen when the unit is severely undercharged. For a unit operating in nominal conditions, the refrigerant is a saturated liquid at the end of the two-phase region of the condenser and the same energy balance reads $$\dot{m}_n h_{fg,n}=\bar{U}_n A_n CTOA_n, \tag{10}$$

where $h_{fg,n}$ is the latent heat of vaporization at the liquid pressure. From equations (9) and (10), one may write $$h_3 = h_g - \frac{\dot{m}_n}{\dot{m}} \frac{\overline{U}}{\overline{U}_n} \frac{A}{A_n} \frac{CTOA}{CTOA_n} h_{fg,n}, \tag{11}$$

If all the variables in equation (11) are known, the enthalpy of the mixture at state 3 can be calculated.

It is worth noting that the mass flow rate, the average overall heat transfer coefficient and the area of the heat exchanger where a two-phase mixture exists all vary with the operating conditions of the cycle. Unfortunately, the average overall heat transfer coefficient and the area of the heat exchanger where two-phase flow exists are difficult to obtain. As an approximation, consider that the product $\overline{U}A/\dot{m}$ does not vary significantly. In that case, the enthalpy of the mixture at the exit of the condenser is $$h_3 \cong h_g - \frac{CTOA}{CTOA_n} h_{fg,n}. \tag{12}$$

Equation (12) is an approximate solution to determine $h_3$ when the refrigerant leaves the condenser as a two-phase mixture.

The value of $CTOA_n$ depends on the nominal EER of the equipment. A suggested value, based on a 10-EER unit, is 20° F.

E. Use the suction line temperature (ST) and pressure (SP) to determine the suction line 18 superheat (SR)

$$SH=ST-ET \tag{13}$$

If SH is greater than 0° F., then estimate the suction line refrigerant specific enthalpy ($h_1$) using the well-known properties of single-phase superheated refrigerant $$h_1=h(ST,SP) \tag{14}$$

If there is no suction line superheat, pressure and temperature are not independent properties, so they can not define the enthalpy. Some other property must be known, such as the quality, to determine the enthalpy at state 1. However, it is important to note that the system should not operate with liquid entering the compressor, because this may cause a catastrophic failure leading to a compressor replacement.

F. Assume there is no enthalpy drop across the expansion device, i.e., $$h_4=h_3 \tag{15}$$

Estimate capacity ($\dot{Q}$) using the estimates of mass flow rate ($\dot{m}$), the liquid line specific enthalpy ($h_4$), and the suction line specific enthalpy ($h_1$) as $$\dot{Q}=\dot{m}(h_1-h_4) \tag{16}$$

G. Divide the capacity ($\dot{Q}$) estimated by the power ($\dot{W}$) to determine the COP (coefficient of performance)

$$COP = \frac{\dot{Q}}{\dot{W}} \tag{17}$$

The EER (energy efficiency ratio) is obtained by converting the COP to units of Btu/h/W. These are two common measures of the cycle's operating efficiency.

H. Estimate the efficiency index by comparing the estimated actual COP to another estimate based on the pressure and temperature measurements that will be used as goals in the service procedure. These measurements represent nominal or desired performance.

To do this, it is necessary to set a standard for the desired performance under the current conditions. Preferably, the desired performance is set by the operating characteristics of a properly operating (i.e., no faults) vapor compression cycle, under the current driving conditions. Thus, for any driving condition, the desired performance is defined by the values of SP, ST, LP, and LT. Unfortunately, this data is usually not available. An alternative is defining the values of important parameters based on experience, as follows:

a) Set the evaporating temperature to a desired constant ($ET_{desired}$). A common value for air-conditioning applications is 40° F. or 45° F.

b) Set the suction line 18 superheat to a desired value ($SH_{desired}$). For units with fixed orifice expansion devices, use the system's (or a universal) charging chart, commonly provided by equipment manufacturer, to estimate desired superheat for the current outdoor ambient temperature (AMB) and perhaps return air wet bulb temperatures. For units with a TXV, a common value for the superheat is 20° F.

c) Set the liquid line subcooling to a desired value ($SC_{desired}$). A common value is 12° F.

d) Set the condensing temperature ($CT_{desired}$) to a desired number of degrees above the measured outdoor ambient temperature. That temperature difference, which may be a function of the design Energy Efficiency Ratio (EER) rating—higher EER units run with cooler condensers—is called $CTOA_{desired}$ (Condensing Temperature Over Ambient).

From the above constraints, the states in the cycle are defined. The suction temperature at desired conditions is $$ST_{desired}=ET_{desired}+SH_{desired} \tag{18}$$

From the outdoor air temperature and the CTOA at desired conditions, one may calculate the saturation temperature at the condenser $$CT_{desired}=AMB+CTOA_{desired} \tag{19}$$

The liquid temperature can be calculated from the condensing temperature ($CT_{desired}$) and the subcooling at desired conditions as $$LT_{desired}=CT_{desired}-SC_{desired} \tag{20}$$

The suction pressure is only a function of the boiling temperature in the evaporator ($ET_{desired}$)

$$SP_{desired}=P_{sat}(ET_{desired}) \tag{21}$$

Finally, the liquid pressure at desired conditions is only a function of the condensing temperature ($CT_{desired}$)

$$LP_{desired}=P_{sat}(CT_{desired}) \tag{22}$$

Equations (1) and (2) can be used to determine the refrigerant mass flow rate ($\dot{m}_{desired}$) and power ($\dot{W}_{desired}$) under the desired conditions. The enthalpies can be determined from equations (8) for $h_{3,desired}$, (14) for $h_{1,desired}$, and (15) for $h_{4,desired}$. The capacity at desired conditions is $$\dot{Q}_{desired}=\dot{m}_{desired}(h_{1,desired}-h_{4,desired}) \tag{23}$$

The COP at desired conditions can be calculated using $$COP_{desired} = \frac{\dot{Q}_{desired}}{\dot{W}_{desired}} \tag{24}$$

The capacity index (CI) can be calculated as the ratio of the actual capacity to the capacity at desired conditions $$CI = \frac{\dot{Q}}{\dot{Q}_{desired}} \tag{25}$$

The efficiency index (EI) can be calculated as the ratio of the actual COP to the COP at desired conditions $$EI = \frac{COP}{COP_{desired}} \tag{26}$$

I. The present invention provides a process for estimating the vapor compression cycle operating costs from the knowledge of CI and EI and other important parameters of the equipment, such as:

NCAP—the nominal capacity of the equipment (or stage, if there is more than one stage in the unit);

NRT—the nominal equipment annual running time (for example, 1,200 hours),

SEER—the Seasonal Energy Efficiency Ratio of the unit;

EP—the price of electricity provided by the utility company (for example, $0.10/kW.h);

PP—the percentage of power used for purposes other than for compressing the refrigerant gas in the compressor, such as for fans and controls (usually around 20%, so PP=0.2). The power used for purposes other than for compressing the gas is assumed constant.

Figure 3:
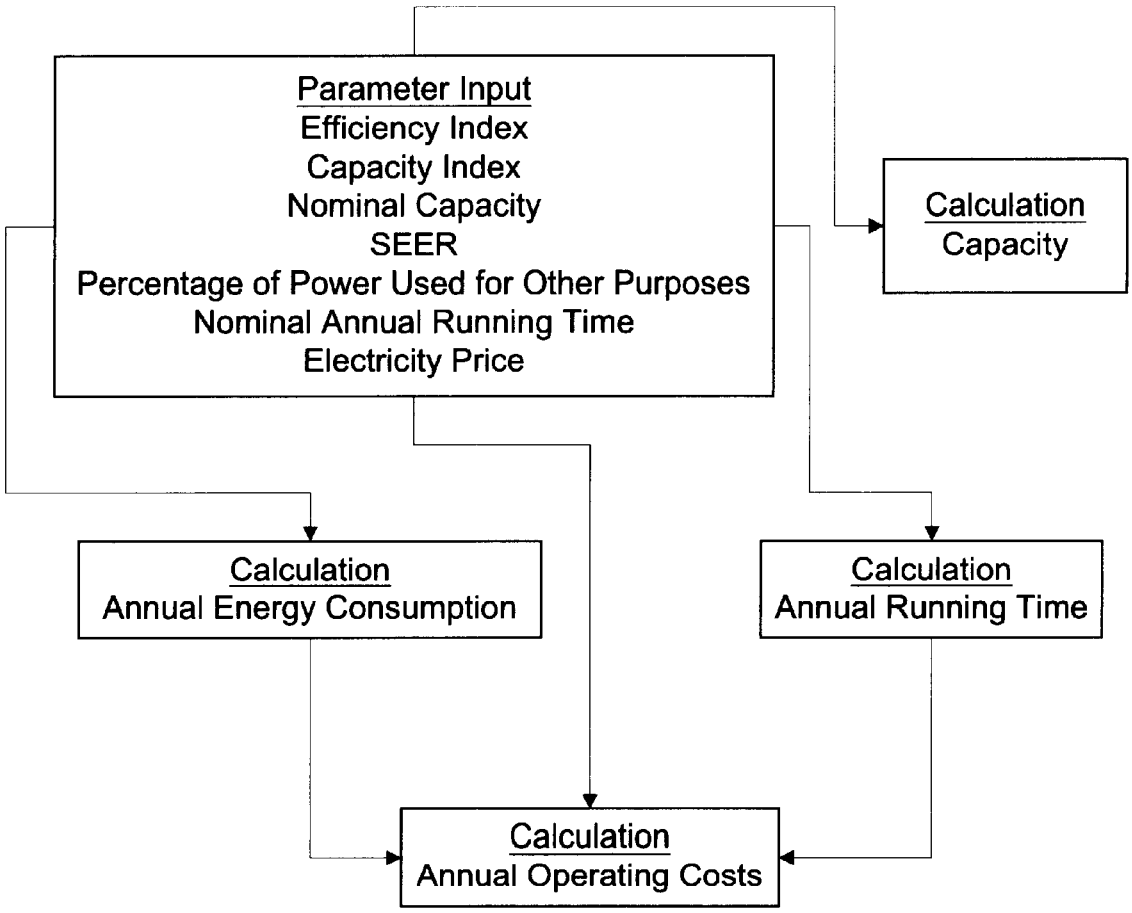
FIG. 3 is a block diagram of the steps of a process for determining operating costs once certain information is known in accordance with the present invention.

Referring now to FIG. 3, the actual capacity is calculated for each stage as $$ACAP=CI\ NCAP. \tag{27}$$

Assume the power consumed for purposes (PCO) other than compressing the gas at the compressor is independent of the operating conditions of the cycle. Therefore, it can be calculated as $$PCO=PP\ NPC, \tag{28}$$

where NPC is the nominal power consumption of the unit, which is $$NPC=\dot{W}_{desired}+PCO, \tag{29}$$

when the unit delivers the nominal capacity NCAP (which is assumed equal to $\dot{Q}_{desired}$). The total power consumption is $$PC=\dot{W}+PCO. \tag{30}$$

From the definitions of EI and CI, and equations (28–30) one can write $$PC = \left(\frac{CI}{EI} + \frac{PP}{1-PP}\right)\dot{W}_{desired}. \tag{31}$$

The definition of SEER is the sum of the cooling divided by the sum of the power over the course of one year. Assuming that $$SEER \cong \frac{\dot{Q}_{desired}}{\dot{W}_{desired} + PCO}. \tag{32}$$

From equations (28–32) the energy consumption can be calculated as $$PC = \left(\frac{CI}{EI}(1-PP) + PP\right)\frac{NCAP}{SEER}, \tag{33}$$

using the appropriate unit conversions, where necessary.

The actual running time of the cycle at the actual capacity is equal to $$ART = \frac{NRT}{CI} \tag{34}$$

The estimated operating costs of the unit can be calculated as $$OC=ART\ EP\ PC. \tag{35}$$

An important feature of this development is a technique that uses compressor performance data provided by manufacturers, with field measurements commonly made by air conditioning and refrigeration technicians. This allows the user to cost effectively estimate the capacity, the coefficient of performance, the efficiency index, and the capacity index of vapor compression cycles in the field. The annual operating costs of the equipment can be estimated from the calculated parameters and can be used to help make better decisions on when service should be provided.

Compressor performance data is provided for each compressor model in industry standard formats and is intended to support design engineers when applying compressors in system applications. In this application, the data is used to evaluate the performance of an actual vapor compression cycle in the field. The measurements used as inputs for the compressor performance data equations are commonly made in the field.

Even when the specific compressor equations are not available for the unit being worked on, the present invention can still be employed to determine the capacity index and the efficiency index. Since they are defined as a ratio, a set of compressor performance data equations for a standard compressor, or a representative compressor of a group of technologies with similar performance could be used to estimate these two indices with reasonable accuracy. This significantly extends the use of this invention.

Although this invention has been described and illustrated by reference to specific embodiments, it will be apparent to those skilled in the art that various changes and modifications may be made which clearly fall within the scope of this invention. The present invention is intended to be protected broadly within the spirit and scope of the appended claims.

We claim:

1. In vapor compression equipment having a compressor, a condenser, an expansion device and an evaporator arranged in succession and connected via a conduit in a closed loop for circulating refrigerant through the closed ioop, said equipment operating within its nominal vapor compression cycle parameters, a process for determining the operating efficiency of the system, the process comprising the steps of:

measuring liquid line pressure, suction line pressure, suction line temperature, and liquid line temperature;

obtaining the suction dew point and discharge dew point temperatures from the suction line and liquid line pressures;

obtaining the suction line superheat;

obtaining the mass flow rate that corresponds to the compressor in the vapor compression cycle for the dew point temperatures and suction line superheat;

obtaining the enthalpies at the suction line and at the inlet of the evaporator; and calculating the capacity of the vapor compression cycle from the mass flow rate and the enthalpies across the evaporator.

2. The process of claim 1 wherein said step of obtaining the mass flow rate comprises the step of calculating compressor performance data from ARI (Air-Conditioning and Refrigeration Institute) Standard 540-1999 performance equations available for the specific compressor.

3. The process of claim 1 wherein said step of obtaining the mass flow rate comprises the step of determining the compressor map equation by reading relevant information from the compressor manufacturer's look-up table for the specific compressor.

4. The process of claim 1 wherein said step of obtaining the mass flow rate comprises the step of determining the compressor map equation by reading relevant information from the compressor manufacturer's look-up table for a compressor similar to the specific compressor used in the vapor compression cycle.

5. The process of claim 1, where the mass flow rate is determined from a compressor similar to but not exactly to said specific compressor in the vapor compression cycle.

6. The process of claim 1, where the refrigerant leaves the condenser as a two-phase mixture and its enthalpy is determined by means of the heat of vaporization of the refrigerant at nominal conditions, and the refrigerant mass flow rate, the average overall heat transfer coefficient and the area of the two-phase region of the condenser at actual and nominal conditions.

7. The process of claim 6, where the enthalpy of the refrigerant leaving the condenser is calculated approximating the product of the average overall heat transfer coefficient by the area, both of the two-phase region of the condenser, divided by the mass flow rate, as a constant value.

8. The process of claim 1, further comprising the step of correcting the mass flow rate when the suction line superheat is different than the one specified by the compressor manufacturer, multiplying it by the ratio of the design suction line absolute temperature over the actual suction line absolute temperature.

9. The process of claim 1 further comprising the steps of:

obtaining the power input to the compressor from the compressor performance data, by means of the suction and discharge dew point temperatures; and determining the coefficient of performance of the vapor compression cycle, equal to the ratio of the capacity over the power input to the compressor.

10. The process of claim 9 wherein said step of obtaining the power input to the compressor comprises the step of calculating compressor performance data from polynomials that utilize ARI Standard 540-1999 performance equations available for the specific compressor.

11. The process of claim 9 wherein said step of obtaining the power input to the compressor comprises the step of determining the compressor map equation by reading relevant information from the compressor manufacturer's look-up table for the specific compressor used in the vapor compression cycle.

12. The process of claim 9 wherein said step of obtaining the power input to the compressor comprises the step of determining the compressor map equation by reading relevant information from the compressor manufacturer's look-up table corresponding to a compressor similar to the specific compressor used in the vapor compression cycle.

13. The process of claim 9, where the power input to the compressor is determined for a compressor similar to but not exactly like said compressor in the vapor compression cycle.

14. The process of claim 9, where the power input to the compressor is measured by a power meter.

15. The process of claim 9, further comprising the step of correcting the power input to the compressor when the suction line superheat is different than the one specified by the compressor manufacturer, multiplying it by the ratio of the design suction line absolute temperature over the actual suction line absolute temperature.

16.The process of claim 9, further comprising the steps of determining the driving conditions by measuring the temperature of the air entering the condenser, the return air temperature and the return air humidity entering the evaporator;

determining the desired conditions for the cycle for the current driving conditions from previously obtained data for the same equipment without faults;

performing calculations to determine the mass flow rate based on the compressor map under desired conditions;

performing calculations to determine the capacity of the cycle under desired conditions and determining the capacity index of the unit as the ratio of the actual capacity of the cycle over the capacity of the vapor compression cycle under desired conditions.

17. The process of claim 16, where the data to determine the desired conditions for the cycle for the current driving conditions is not available and the desired conditions are determine by setting the evaporating temperature, the suction line superheat, the liquid line subcooling, and the condensing over ambient temperature to values based on experience.

18. The process of claim 16, further comprising the steps of:

performing calculations to determine the power input to the cycle under desired conditions;

determining the coefficient of performance of the cycle under desired conditions, as the ratio of the capacity over the power input;

determining the efficiency index of the unit as the ratio of the actual coefficient of performance of the cycle over the coefficient of performance of the cycle under desired conditions.

19. The process of claim 18, further comprising the steps of:

calculating the capacity of the system, by multiplying the nominal unit capacity, as published by the manufacturer, by the capacity index;

calculating the annual energy consumption of the unit by means of its nominal capacity, its SEER, the calculated capacity and efficiency indices, and the estimated percentage of the power used by the for purposes other than compressing the gas in the compressor;

calculating the actual annual running time of the unit as the ratio of the nominal annual running time over the capacity index;

obtaining the price of electricity in a form of currency per unit of energy;

estimating the annual operating costs by multiplying the actual annual running time of the unit, the electricity price, and the calculated energy consumption.

20. In a vapor compression cycle having a compressor, a condenser, an expansion device and an evaporator arranged in succession and connected via conduit in a closed loop in order to circulate refrigerant through the closed loop, said vapor compression cycle, a predetermined process for determining if the compressor is operating near design performance, the process comprising the steps of:

measuring liquid line pressure and suction line pressure;

obtaining the suction and discharge dew point temperatures;

obtaining the theoretical current draw of compressor through the ARI Standard 540-1999 equation;

measure actual current draw in all legs leading to compressor;

comparing actual current draw to theoretical current draw to establish whether compressor is operating near design performance.

21. The process of claim 20, where instead of measuring the current draw, the power input to the compressor is measured and compared with the calculated.

* * * * *

UNITED STATES PATENT AND TRADEMARK OFFICE

CERTIFICATE OF CORRECTION

PATENT NO. : 6,701,725 B2
DATED : March 9, 2004
INVENTOR(S) : Rossi et al.

It is certified that error appears in the above-identified patent and that said Letters Patent is hereby corrected as shown below:

Column 9,
Line 29, delete "(SR)" and substitute therefor -- (SH) --

Signed and Sealed this

Twenty-seventh Day of July, 2004

JON W. DUDAS
*Acting Director of the United States Patent and Trademark Office*